US009388572B2

(12) United States Patent
Gates et al.

(10) Patent No.: US 9,388,572 B2
(45) Date of Patent: Jul. 12, 2016

(54) SYSTEM FOR SOUND ISOLATION

(71) Applicant: G2 Group LLC, Las Vegas, NV (US)

(72) Inventors: James Richard Gates, San Dimas, CA (US); Elzo Forrest Gernhart, Las Vegas, NV (US)

(73) Assignee: G2 Group, LLC, Las Vegas, NV (US)

( * ) Notice: Subject to any disclaimer, the term of this patent is extended or adjusted under 35 U.S.C. 154(b) by 0 days.

(21) Appl. No.: 14/705,894

(22) Filed: May 6, 2015

(65) Prior Publication Data

US 2015/0233111 A1 Aug. 20, 2015

Related U.S. Application Data

(63) Continuation-in-part of application No. 14/249,889, filed on Apr. 10, 2014, now Pat. No. 9,051,730.

(60) Provisional application No. 61/811,476, filed on Apr. 12, 2013.

(51) Int. Cl.

| | |
|---|---|
| ***G10K 11/16*** | (2006.01) |
| ***E04B 2/74*** | (2006.01) |
| *E04B 1/82* | (2006.01) |

(52) U.S. Cl.

CPC ..... *E04B 2/7409* (2013.01); *E04B 2/7412* (2013.01); *E04B 2001/8272* (2013.01)

(58) Field of Classification Search

CPC ..... G10K 11/16
USPC ..... 181/207
See application file for complete search history.

(56) References Cited

U.S. PATENT DOCUMENTS

| | | | | |
|---|---|---|---|---|
| 3,228,640 | A | | 1/1966 | Wolsh |
| 3,421,281 | A | | 1/1969 | Harris |
| 4,110,948 | A | * | 9/1978 | Maier, Jr. ..... 52/402 |
| 4,783,039 | A | | 11/1988 | Peterson |
| 4,844,401 | A | | 7/1989 | Tenniswood |
| 4,879,856 | A | | 11/1989 | Jones et al. |
| 5,013,002 | A | | 5/1991 | Lefferts |
| 5,201,489 | A | | 4/1993 | Wolf |
| 5,441,224 | A | | 8/1995 | Ludwig |

(Continued)

OTHER PUBLICATIONS soundisolationcompany.com, Resilmount Isolation Clips, Catalog http://www.soundisolationcompany.com/solutions-products/sound-proof-walls/resilmount-sound-isolation-clips.

(Continued)

*Primary Examiner* — Forrest M Phillips
(74) *Attorney, Agent, or Firm* — Hankin Patent Law, APC; Jimmy Sauz; Kevin Schraven

(57) ABSTRACT

A system for sound isolation. The system is configured to acoustically isolate a gypsum board support channel from a frame member. The system may comprise: a sound isolation clip and fastener, wherein the sound isolation clip comprises a slit configured for mounting onto a flange of a support channel and a fastener hole for securing the fastener and sound isolation clip onto the flange of the support channel. The fastener may be a screw and may comprise a wafer head and shank with a threaded portion and a smooth portion. The threaded portion is used to fasten and secure the mounting screw, sound isolation clip, and support channel onto a wall-board panel and support frame. The smooth portion is used to allow the sound isolation clip to freely move when engaged with the support channel and uniformly distribute the static dead load into the sound isolation clip.

8 Claims, 10 Drawing Sheets

(56) References Cited

U.S. PATENT DOCUMENTS

| | | | | |
|---|---|---|---|---|
| 5,550,338 | A * | 8/1996 | Hielscher | 181/290 |
| 5,778,621 | A * | 7/1998 | Randjelovic | 52/403.1 |
| 6,115,981 | A * | 9/2000 | Counihan | 52/403.1 |
| 6,267,347 | B1 * | 7/2001 | Ryan et al. | 248/562 |
| 6,367,216 | B1 | 4/2002 | Maylon | |
| 6,615,559 | B2 | 9/2003 | McGrath et al. | |
| 6,711,867 | B1 | 3/2004 | Smith | |
| 7,093,814 | B2 * | 8/2006 | Meisel et al. | 248/562 |
| 7,647,744 | B2 | 1/2010 | Payne, Jr. | |
| 7,735,285 | B2 | 6/2010 | Payne, Jr. | |
| 7,895,803 | B2 | 3/2011 | Downey et al. | |
| 8,162,104 | B2 * | 4/2012 | Bastion et al. | 181/284 |
| 9,045,898 | B2 * | 6/2015 | Ravnaas | |
| 2002/0157329 | A1 * | 10/2002 | Berdan, II | 52/144 |
| 2009/0173029 | A1 * | 7/2009 | Socha et al. | 52/506.08 |
| 2011/0140325 | A1 | 6/2011 | Downey et al. | |
| 2012/0192925 | A1 | 8/2012 | Grushkowitz | |

OTHER PUBLICATIONS noisereductionenterprises.com, RSIC Clips Wall Isolation Clips, Catalog, 2012 http://noisereductionenterprises.com/rsic-clips/.

totalvibrationsolutions.com, Resilient Sound Isolation Wall and Ceiling Clip, Flyer, Jun. 2004 http://www.totalvibrationsolutions.com/pdf/isomax.pdf.

Pliteq, GenieClip, Flyer http://www.docstoc.com/docs/101493347/Genie-Clip.

* cited by examiner

SYSTEM FOR SOUND ISOLATION

CROSS-REFERENCE TO RELATED APPLICATIONS

This Application is a Continuation-in-Part Application of U.S. Non-Provisional patent application Ser. No. 14/249,889, filed on Apr. 10, 2014, titled "System for Sound Isolation", by co-inventors James Richard Gates and Elzo Forrest Gernhart, the contents of which are expressly incorporated herein by this reference as though set forth in their entirety, and to which priority is claimed. U.S. Non-Provisional patent application Ser. No. 14/249,889 claims the benefit of from U.S. Provisional Patent Application No. 61/811,476, filed on Apr. 12, 2013, titled "Sound Isolation Clip", by co-inventors James Richard Gates and Elzo Gernhart, the contents of which are expressly incorporated herein by this reference as though set forth in their entirety, and to which priority is claimed.

FIELD

The present disclosure relates generally to sound isolation devices used to acoustically isolate gypsum board panels from the structure and sound sources. More specifically, the present disclosure generally relates to sound isolation systems comprising a sound isolation clip and mounting screw that attaches onto a resilient channel or furring channel for acoustically isolating finishes including gypsum boards from the structure and sound sources.

BACKGROUND

When designing homes and buildings, especially in multi-family housing complexes, many developers face problems in isolating acoustics in-between rooms and units. To address this problem, support channels such as resilient channels and furring channels, in conjunction with sound isolation clips, have been used to decouple and isolate the sound vibrations that pass through the structural members and finishes, including gypsum board panels.

A support channel is typically a long, metal strip with one or more flanges protruding outwards. The support channel is generally used to reduce the amount of sound that is conducted through the structure and is generally fastened directly onto either ceiling or wall framing members to secure the finishes, including gypsum boards and frame supports of the structure. As sound waves passing through the structural members are terminated, a secondarily path of sound transmission through the gypsum board panels is created. Sound waves become absorbed within the space area enclosed by the finishes and gypsum board, thereby insulating the adjacent room from noise. Examples of support channels that are commonly used are the resilient channel (e.g., RC-1 resilient channel) and the furring channel (e.g., hat channel).

Despite the sound isolation characteristics of a support channel, a desired level of acoustical isolation is sometimes not met. Thus, developers have addressed this issue by also incorporating a sound isolation clip along with the support channel. A sound isolation clip is generally a fastening device that assists the support channel member in dampening the acoustics transmitted through a wall or ceiling. The sound isolation clip typically includes a bracket and screw and preferably attaches onto one or more flanges of a support channel, such that the support channel fastens and suspends onto the underlying frame support of a wall. For example, U.S. Pat. No. 7,647,744 issued to Payne discloses a sound clip that attaches to a lip of a resilient channel to further acoustically isolate vibrations in the drywall from the stud. The sound clip disclosed in Payne is constructed of a metal strip or band and utilizes two bushings or grommets. Although the clip disclosed in Payne is used to fasten the resilient channel to a wall frame to acoustically isolate vibrations in the drywall, the sound isolation clip in Payne is relatively stiff and rigid with limited deflection when attached onto a wallboard panel and support frame. This, in turn, generally results with lack of effective sound dissipation and acoustic absorption through a wall and double deflection. The teachings disclosed in Payne do not disclose the contribution of a smooth shank mounting screw as is incorporated in the sound isolation clip utility disclosed herein. The smooth shank mounting screw allows free movement and thereby double deflection at the critical mountings point thereby terminating structure born noise transmission.

Furthermore, the installation of conventional sound clips may be complicated, thereby resulting with a failure to achieve the desired sound insulation. For example, U.S. Pat. No. 7,895,803 issued to Downey discloses a clip to be attached to two flanges of a drywall furring channel which has two protrusions. However, the Downey clip is directed to only furring channels and is very difficult to install because the location of the attachment screws are covered by the drywall furring channel. Furthermore, other sound isolation clips in the marketplace are also generally spaced in a staggered pattern, making the field installation more complicated. Because a span limitation exists on the resilient channel—that is, each flange of the resilient channel is only a half-inch thick and has only one mounting point—installation of the sound isolation clip is restricted to every intersection between the structural member and furring channel.

Thus, there is a long felt need for an improved system for sound isolation that is inexpensive, easy to install, and significantly dampens sound. Because most sound isolation clips are configured to be installed in a staggered pattern, the improved sound isolation clip is preferably installed in every intersection between the channel and the structural member while not covered by the support channel, thereby making the installation of the sound isolation clip extraordinarily simple and uncomplicated.

SUMMARY

To minimize the limitations in the cited references, and to minimize other limitations that will become apparent upon reading and understanding the present specification, the following discloses a system for sound isolation that further reduces the amount of sound transferring through a wall or ceiling.

One embodiment a system for sound isolation, comprising: a sound isolation clip; wherein the sound isolation clip comprises a slit and two body portions; wherein the slit is approximately in-between the two body portions, such that the sound isolation clip is substantially u-shaped and the two body portions are substantially in parallel; wherein the slit is configured to engage with a support channel; wherein the support channel comprises at least one flange and at least one mounting point on the at least one flange; wherein the sound isolation clip is configured to be mounted onto the at least one mounting point; wherein the sound isolation clip and the support channel are configured to be mounted onto a frame member of a structure; wherein the support channel is part of a barrier between two spaces; and wherein the sound isolation clip is configured to substantially isolate one or more vibrations at the frame member, such that sounds traveling between the two spaces are decreased. The system for sound isolation may further comprise a fastener; wherein the fastener may be configured to secure the sound isolation clip to the mounting point of the support channel and the frame member of the structure, when the sound isolation clip mounts onto the mounting point of the support channel and when the fastener engages with the two body portions of the sound isolation clip, the mounting point of the support channel, and the frame member of the structure; and wherein the sound isolation clip and the fastener may be configured to substantially isolate one or more vibrations at the frame member, such that sounds traveling between the two spaces may be decreased. The fastener may comprise a head and a shank; wherein the shank of the fastener may comprise a threaded portion and a smooth portion; wherein the threaded portion may be configured to engage with the frame member of the structure; and wherein the smooth surface portion may be configured to engage with the two body portions and the at least one flange of the support channel, such that only the two body portions and the at least one flange may engage with the smooth portion of the shank and only the threaded portion engages with the frame member of the structure. The smooth portion of the shank may be between approximately 0.6 inches and 0.65 inches. A thickness of the sound isolation clip may be between approximately 0.4 inches and 0.6 inches, such that a thickness of each of the body portion is approximately between 0.2 and 0.3 inches. The fastener may be a wafer-head screw; wherein a bottom surface of the head of the wafer-head screw may be substantially flat; and wherein the bottom surface of the wafer head screw may be configured to substantially cover and engage with a surface of at least one of the two body portions of the sound isolation clip and to hold the sound isolation clip at a prescriptive compression, such that, when sound travels through the support channel and the sound isolation clip, the sound isolation clip and the fastener may dampen the sound at one or more desired frequency ranges. A length of each of the two body portions may be approximately between 0.6 inches and 0.65 inches; and wherein the diameter of the head of the wafer head screw may be approximately between 0.4 inches and 0.45 inches. Each of the two body portions may be symmetrical to each other. The sound isolation clip may be substantially rectangular in shape. The sound isolation clip may be constructed of an elastic polymer or natural rubber or a combination of natural or man-made compounds.

Another embodiment may be a system for sound isolation, comprising: a sound isolation clip; and a fastener; wherein the sound isolation clip comprises a slit, a fastener hole, and two body portions; wherein the sound isolation clip lacks one or more grommets; wherein the fastener hole is configured to allow the fastener to engage with the two body portions; wherein the slit is approximately in-between the two body portions, such that the sound isolation clip is substantially u-shaped and the two body portions are substantially in parallel; wherein the slit is configured to slideably engage with a single flange of a support channel, such that a single sound isolation clip is used for each flange of the support channel; wherein the flange of the support channel comprises at least one mounting point; wherein the fastener comprises a head and a shank; wherein the fastener is configured to secure the sound isolation clip to the flange of the support channel, when the slit of the sound isolation clip engages with the flange of the support channel and when the shank of the fastener engages with the two body portions of the sound isolation clip, the mounting point of the flange, and a frame member of a structure; wherein the support channel is part of a barrier between two spaces; and wherein the sound isolation clip and the fastener are configured to substantially isolate one or more vibrations at the frame member, such that sounds traveling between the two spaces are decreased. The shank of the fastener may comprise a threaded portion and a smooth portion; wherein the threaded portion may be configured to engage with the frame member of the structure; and wherein the smooth surface portion may be configured to engage with the two body portions and the flange of the support channel, such that only the two body portions and the flange may engage with the smooth portion of the shank and only the threaded portion may engage with the frame member of the structure. The smooth portion of the shank may be between approximately 0.6 inches and 0.65 inches. A thickness of the sound isolation clip may be between approximately 0.4 inches and 0.6 inches, such that a thickness of each of the body portion may be approximately between 0.2 and 0.3 inches. The fastener may be a wafer-head screw; wherein a bottom surface of the head of the wafer-head screw may be substantially flat; and wherein the bottom surface of the wafer head screw may be configured to substantially cover and engage with a surface of at least one of the two body portions of the sound isolation clip and to hold the sound isolation clip at a prescriptive compression, such that, when sound travels through the support channel and the sound isolation clip, the sound isolation clip and the fastener may dampen the sound at one or more desired frequency ranges. A length of each of the two body portions may be approximately between 0.6 inches and 0.65 inches; wherein the diameter of the head of the wafer head screw may be approximately between 0.4 inches and 0.45 inches. Each of the two body portions may be symmetrical to each other. The sound isolation clip may be substantially rectangular in shape. The sound isolation clip may be constructed of an elastic polymer or natural rubber or a combination compound.

Another embodiment may be a system for sound isolation, comprising: a sound isolation clip; and a wafer-head screw; wherein the sound isolation clip is constructed solely of an elastic polymer and comprises a slit, a fastener hole, and two body portions; wherein the sound isolation clip lacks one or more grommets; wherein a length of each of the two body portions is approximately between 0.6 inches and 0.65 inches; wherein each of the two body portions is symmetrical to each other and is substantially rectangular in shape; wherein the fastener hole is positioned is configured to allow the wafer-head screw to engage with the two body portions; wherein the slit is approximately in-between the two body portions, such that the sound isolation clip is substantially u-shaped and the two body portions are substantially in parallel; wherein the slit is configured to slideably engage with a single flange of a support channel, such that a single sound isolation clip is used for each flange of the support channel; wherein the flange of the support channel comprises at least one mounting point; wherein the wafer head screw comprises a head and a shank; wherein the diameter of the head of the wafer head screw approximately between 0.4 inches and 0.45 inches; wherein a bottom surface of the head of the wafer-head screw is substantially flat; wherein the bottom surface of the wafer head screw is configured to substantially cover and engage with a surface of at least one of the two body portions of the sound isolation clip and to hold the sound isolation clip at a prescriptive compression, such that, when sound travels through the support channel and the sound isolation clip, the sound isolation clip and the fastener dampen the sound at one or more desired frequency ranges; wherein the wafer head screw is configured to secure the sound isolation clip to the flange of the support channel, when the slit of the sound isolation clip engages with the flange of the support channel and when the shank of the wafer head screw engages with the two body portions of the sound isolation clip, the mounting point of the flange, and a frame member of a structure; wherein the shank of the wafer head screw comprises a threaded portion and a smooth portion; wherein the smooth portion of the shank is between approximately 0.6 inches and 0.65 inches; wherein a thickness of the sound isolation clip is between approximately 0.4 inches and 0.6 inches, such that a thickness of each of the body portion is approximately between 0.2 and 0.3 inches; wherein the threaded portion is configured to engage with the frame member of the structure; wherein the smooth surface portion is configured to engage with the two body portions and the flange of the support channel, such that only the two body portions and the flange engage with the smooth portion of the shank and only the threaded portion engages with the frame member of the structure; wherein the support channel is part of a barrier between two spaces; wherein the sound isolation clip and the wafer head screw are configured to substantially isolate one or more vibrations at the frame member, such that sounds traveling between the two spaces are decreased; and wherein the support channel is selected from the group of support channels consisting of: a resilient channel and a furring channel.

It is an object to provide a sound isolation clip that may reduce the level of acoustic energy transferred through a finishing, including gypsum board panels.

It is an object to increase and improve the vibration (energy) absorption and decoupling capacity of a support channel such as a resilient channel and furring channel.

It is an object to provide a sound isolation clip that may be relatively easy to install.

It is an object to overcome the limitations of the prior art.

Other features and advantages are inherent in the system for sound isolation claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF ILLUSTRATIVE EMBODIMENTS

Figure 1:
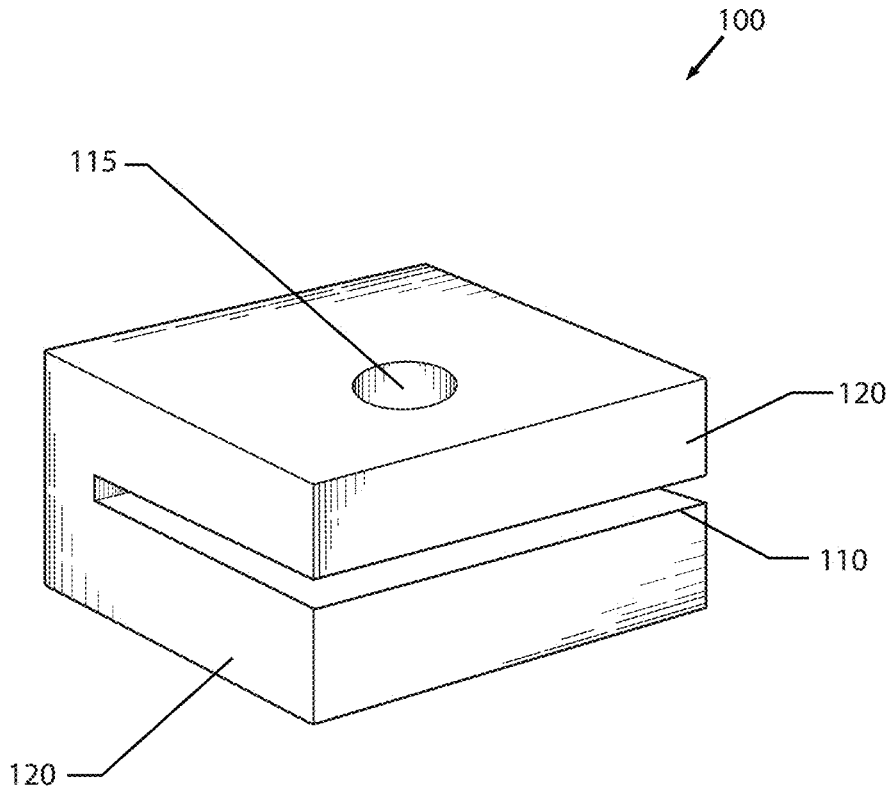
FIG. 1 is an illustration of a perspective view of one embodiment of a sound isolation clip.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For example, the term "sound isolation clip" generally refers to a device used for soundproofing walls and ceilings and is generally configured to attach onto a flange of a support channel. The sound isolation clip is usually attached onto the flange of the support channel by a fastener such as a screw and is generally configured to substantially isolate one or more vibrations or sound waves, such that sounds traveling between the two spaces are decreased.

As used herein, the term "decrease" generally refers to reduce or cause to reduce gradually less or smaller the amount of sound travelling through a barrier (e.g. wall or ceiling) and between two spaces.

As used herein, the term "fastener" generally refers to any device or compound that secures one or more devices to other devices. The term fastener may refer to one or more mating elements that attaches and secures the sound isolation clip to a flange of a support channel, or secures the support channel to a structure including gypsum boards, including without limitation, screws, bolts, nuts, rivets, washers, nuts, clamps, adhesives, lock nuts, rods, pins, ultrasonic welding, and the like. In a preferred embodiment, the fastener is a wafer head mounting screw.

As used herein, the term "support channel" generally refers to any long, metal strip that is generally used to reduce and/or isolate acoustics in-between rooms and units of a structure, including without limitation, resilient channels and furring channels. The support channel generally comprises one or more flanges protruding outwards and is generally fastened directly onto either ceiling or wall framing members to secure the finishes, including gypsum boards and frame supports of the structure. The support channel may be made from any material, and is not restricted to metal.

As used herein, the term "resilient channel" generally refers to a long, generally "Z shaped" metal strip with a single flange protruding outwards. The resilient channel is generally fastened directly onto either ceiling or wall framing members to secure the finishes and frame support of a structure and is generally used to reduce the amount of sound that is conducted through the structure. The term "furring channel" generally refers to any generally "hat-shaped" metal strip with double flanges protruding outwards Like the resilient channel, the furring channel is generally fastened and secured directly to structural support members, such as studs, to serve as a mounting location for ceiling or wall framing members. The furring channel also functions to reduce the amount of sound that is conducted through a structure. An example of a furring channel that is commonly used is sometimes referred to as a hat channel or resilient channel 2 (RC-2). The resilient and furring channels may be made from any material, and are not restricted to metal.

The present specification discloses an improved system for sound isolation. The system is generally configured to acoustically isolate a wallboard support channel from a frame member. The system for sound isolation may comprise: a sound isolation clip and fastener. The sound isolation clip may be generally u-shaped and comprise a slit, groove, notch, or channel, configured for mounting onto, or otherwise engaging with a flange of a support channel. The sound isolation clip may comprise a fastener hole for securing the fastener and sound isolation clip onto the flange of the support channel. The fastener may be a wafer head screw and may comprise a head and shank, wherein the shank comprises a threaded portion and a smooth portion. The threaded portion may be used to fasten and secure the mounting screw, sound isolation clip, and support channel onto a wallboard panel and/or support frame. The smooth portion may be configured to allow the sound isolation clip to freely move when engaged with the support channel and uniformly distribute the static dead load into the sound isolation clip.

FIG. 1 is an illustration of a perspective view of one embodiment of a sound isolation clip. As shown in FIG. 1, one embodiment of the sound isolation clip 100 may comprise: a slit 110, fastener hole 115, and body portions 120. FIG. 1 shows that the sound isolation clip 100 may have two body portions and may have slit 110 in-between the two body portions 120, such that the sound isolation clip may be constructed generally as a "U" shaped block. Additionally, the sound isolation clip 100 may be substantially rectangular in shape and may be constructed of any synthetic, manmade or natural material. In a preferred embodiment, however, the sound isolation clip 100 is generally constructed of an elastic polymer such as rubber or plastic.

Figure 5:
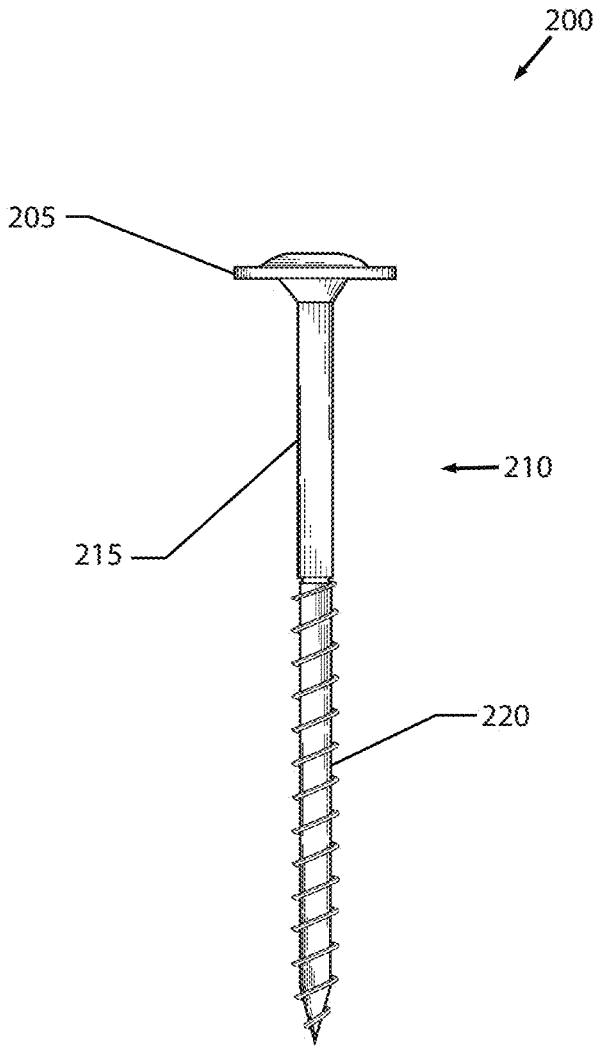
FIG. 5 is an illustration of a side view of one embodiment of a fastener.
Figure 6:
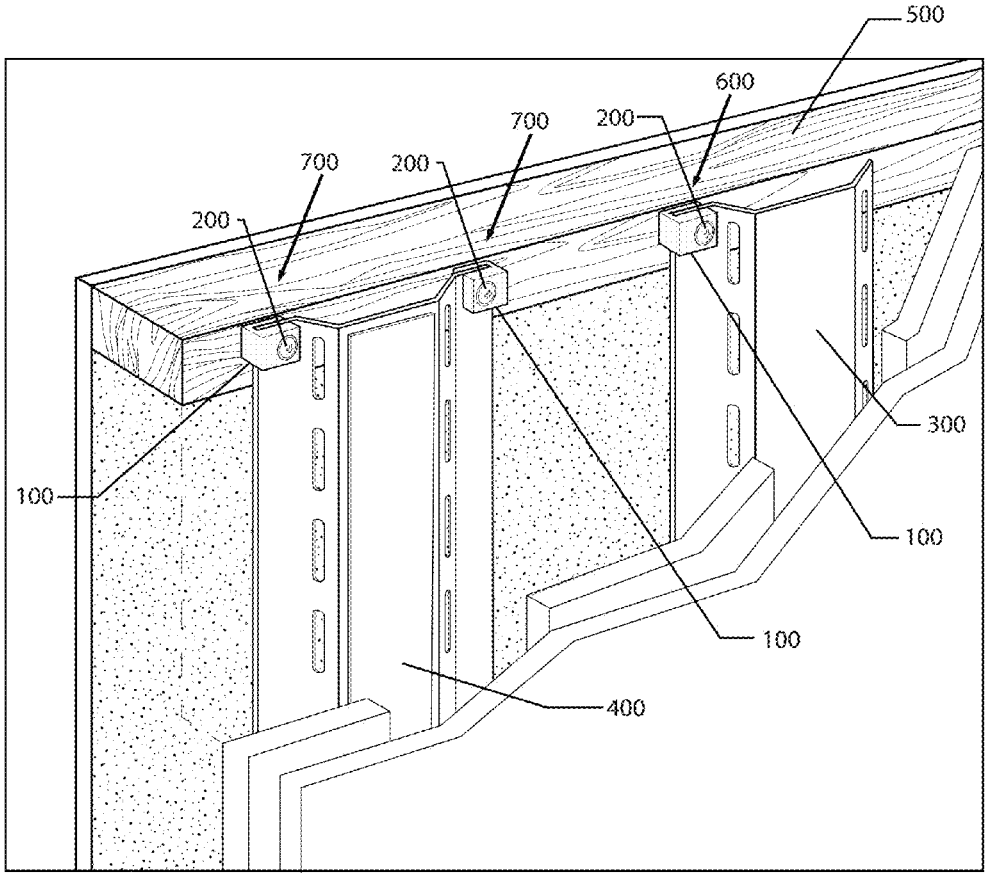
FIG. 6 is an illustration of a perspective view of one embodiment of the system for sound isolation, showing installation with a resilient channel and furring channel.
Figure 7:
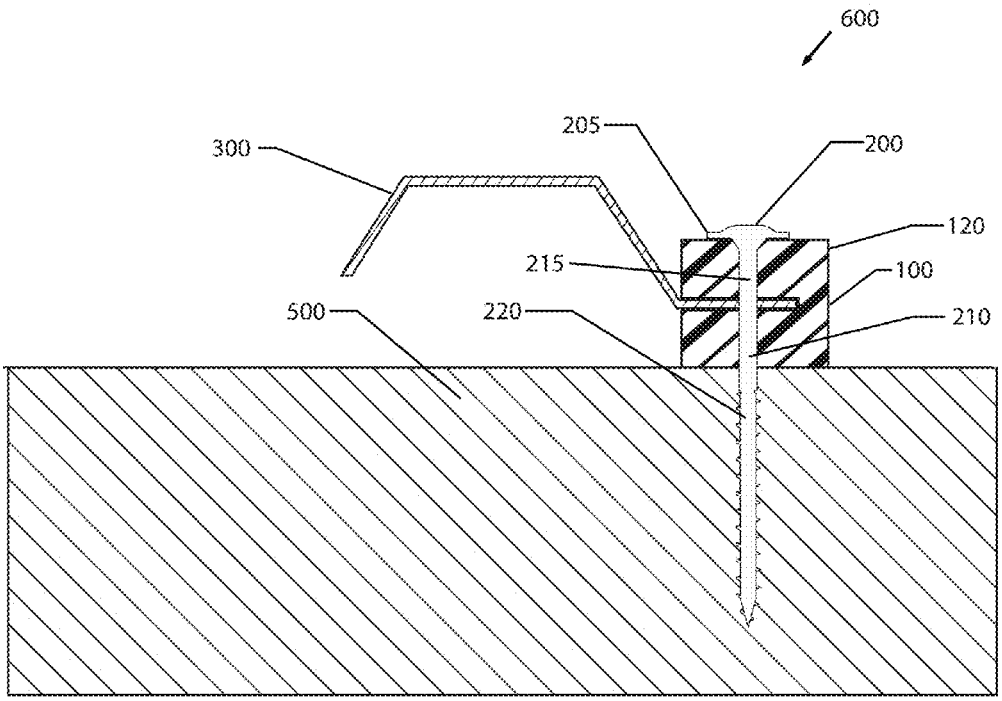
FIG. 7 is an illustration of a cross-sectional view of one embodiment of the system for sound isolation and shows the system installed onto a flange of a resilient channel.
Figure 8:
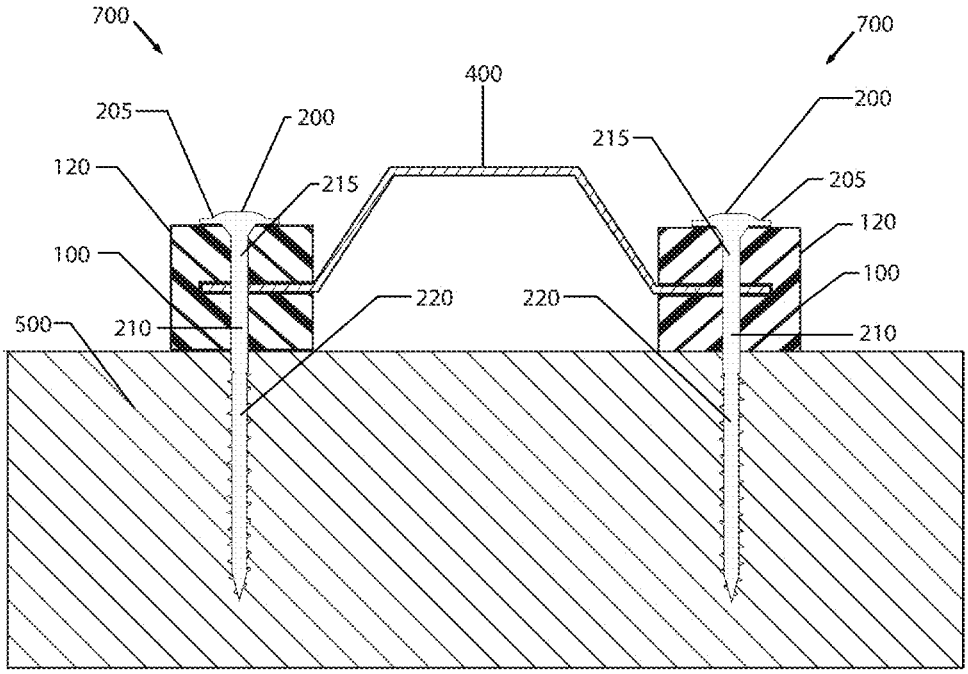
FIG. 8 is an illustration of a cross-sectional view of one embodiment of the system for sound isolation and shows the system installed onto a flange of a furring channel.

As discussed above, the slit 110 may be located in between the two body portions 120 and may be configured to matingly engage with the flange of a support channel (shown in FIGS. 6-8). As shown, the body portions 120 may also generally be symmetrical to one another. The fastener hole 115 may be configured to matingly engage with a fastener 200 (shown in FIG. 5) such as a mounting screw. Specifically, when the slit 110 engages with the flange of the support channel, the fastener 200 may penetrate through the: (1) fastener hole 115 of the sound isolation clip 100; (2) mounting point of the flange of a support channel; and (3) frame support of a structure. As a result, the support channel is generally suspended onto the underlying frame support of a wall, ceiling, and/or floor. In this configuration, the sound isolation clip 100 may substantially isolate one or more acoustics or vibrations, such that sounds traveling between the two spaces are decreased.

In an embodiment, the dimensions of the sound isolation clip 100 may be generally as follows: the length is approximately 0.75 inches; the width is approximately 0.63 inches; and the height is 0.55 inches. The slit may be located at approximately at the centerline width of the sound isolation clip 100 and is usually approximately 0.05 inches, such that each of the body portions may each be approximately 0.25 inches in height. Finally, the fastener hole 115 may be located at approximately at the center of the body portions 120 and may have a thickness of 0.15 inches.

The two body portions of the sound isolation clip 100 may be generally symmetrical. Generally, a single sound isolation clip is installed for each flange of the support channel. This generally results with easier installation of the sound isolation clip, thereby reducing installation time. More than one sound isolation clip 100 may be used without deviating from the scope of the invention. In an embodiment, the dimensions of the sound isolation clip 100 may be generally as follows: the length is approximately 0.75 inches; the width is approximately 0.63 inches; and the height is 0.55 inches. The slit may be located at approximately at the centerline width of the sound isolation clip 100 and is usually approximately 0.05 inches, such that each of the body portions may each be approximately 0.25 inches in height. Finally, the fastener hole 115 may be located at approximately at the center of the body portions 120 and may have a thickness of 0.15 inches.

In a preferred embodiment, the dimensions of the sound isolation clip 100 may be generally as follows: 0.75 inches× 0.650 inches×0.575 inches. The slit 110 may be 0.085" tall and 0.50" deep. The hole diameter of the fastener hole 115 may be 0.150 inches. Each of the body portions may be 0.250 inches thick.

Figure 2:
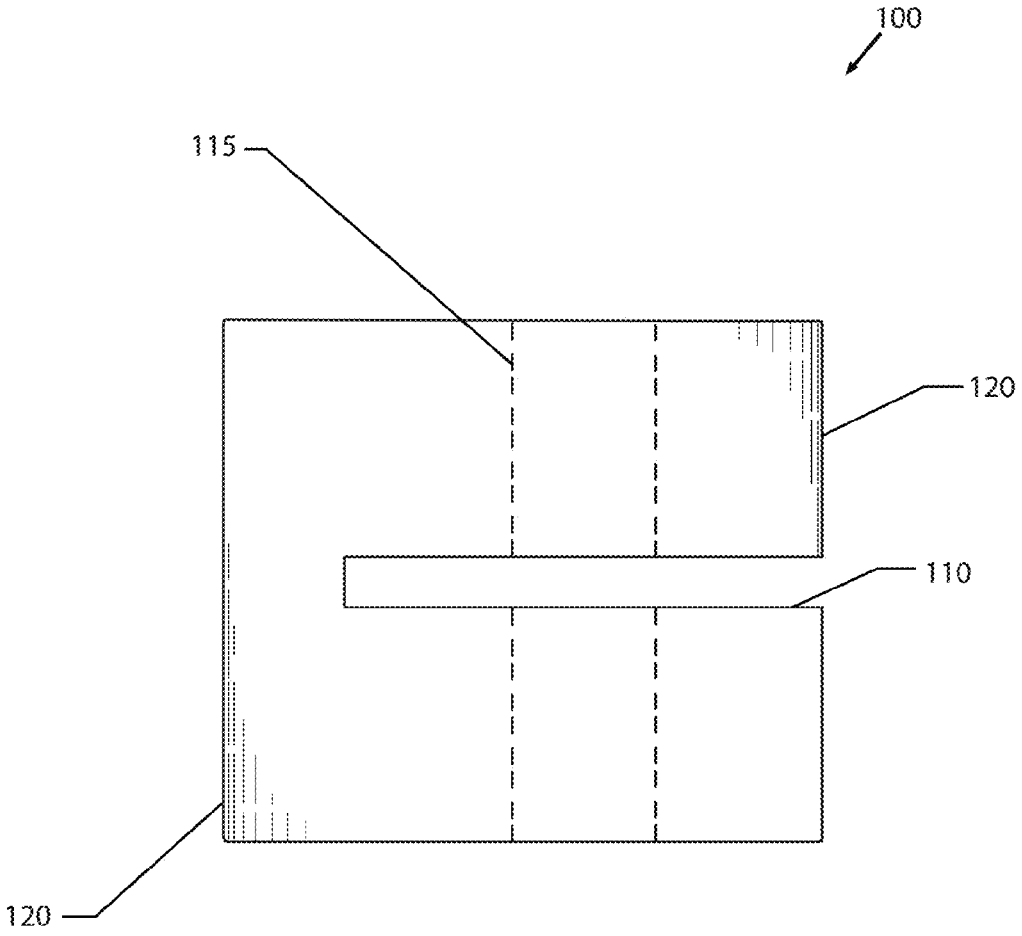
FIG. 2 is an illustration of a side view of one embodiment of the sound isolation clip.

FIG. 2 is an illustration of a side view of one embodiment of the sound isolation clip. As shown in FIG. 2, the one embodiment of the sound isolation clip 100 may comprise: a slit 110, fastener hole 115, and body portions 120.

Figure 3:
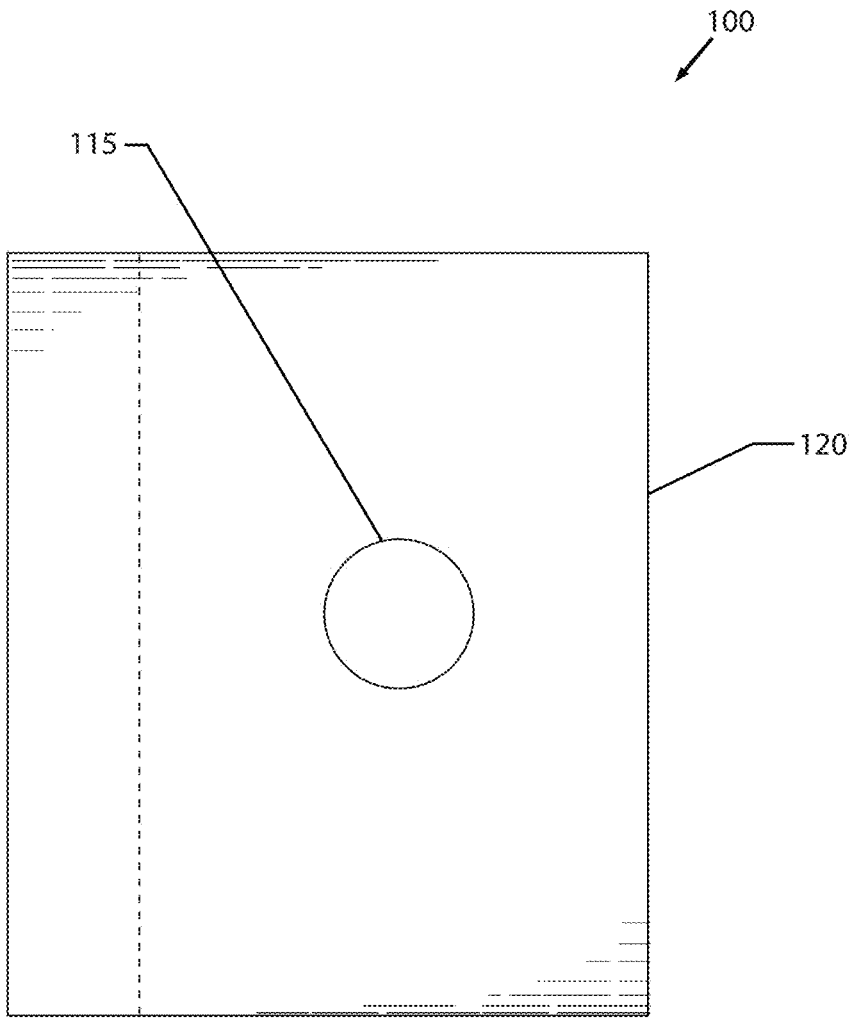
FIG. 3 is an illustration of a top view of one embodiment of the sound isolation clip.

FIG. 3 is an illustration of a top view of one embodiment of the sound isolation clip. As shown in FIG. 3, the one embodiment of the sound isolation clip 100 may comprise a fastener hole 115 and body portion 120.

Figure 4:
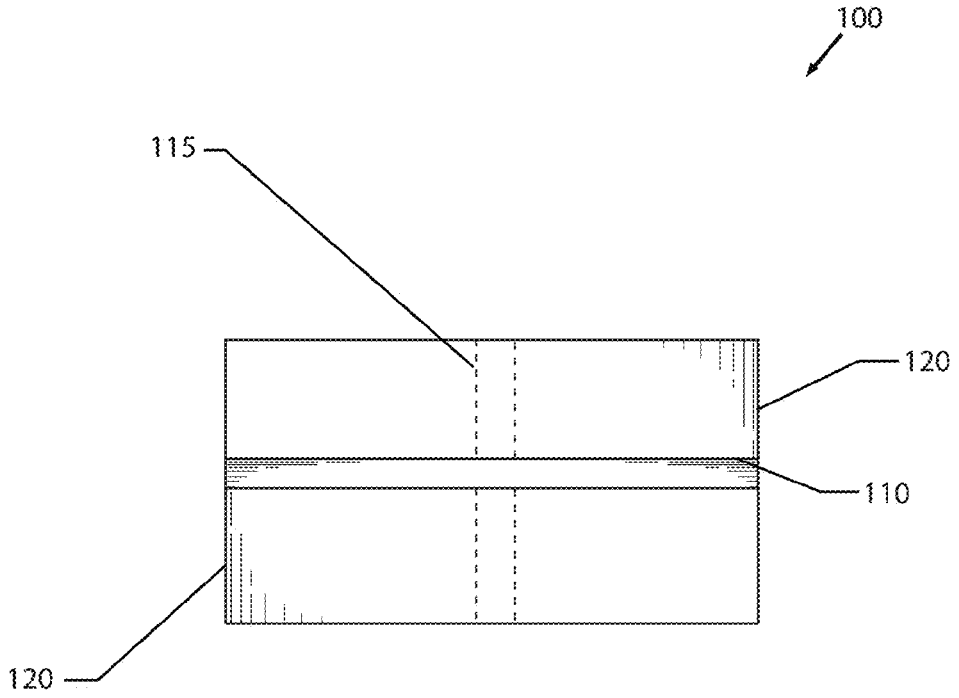
FIG. 4 is an illustration of a front view of one embodiment of the sound isolation clip.

FIG. 4 is an illustration of a front view of one embodiment of the sound isolation clip. As shown in FIG. 4, the sound isolation clip 100 may comprise: a slit 110, fastener hole 115, and body portions 120.

FIG. 5 is an illustration of a side view of one embodiment of a fastener. As shown in FIG. 5, the one embodiment of the fastener 200 may comprise: a head 205 and a shank 210, wherein the shank 210 may comprise a smooth portion 215, and threaded portion 220. The fastener 200 generally represents an important part in the function of the system for sound isolation by allowing the support channel to limited movement on the smooth portion 215 of the fastener 200 while, at the same time, engaging the threaded portion 220 of the fastener 200 to the frame member of the structure. This configuration generally provides substantial shear and load support and further distribution of the static dead load.

FIG. 5 also shows the fastener 200 as a wafer head screw with a large diameter head 205 and that the shank 210 comprises a smooth portion 215 and threaded portion 220. When engaged with the sound isolation clip 100 and mounting point of a flange of a support channel, the smooth portion 215 of the shank 210 generally only contacts the sound isolation clip 100 and flange of the support channel. Thus, in a preferred embodiment, the smooth portion 215 of the shank 210 is generally at least 0.55 inches, which may be equivalent to the thickness of the sound isolation clip 100, whereas the threaded portion 220 may be 0.65 inches or more.

Regarding the head 205 of the fastener 200, the head 205 generally has a large diameter, and the bottom surface of the head 205 is generally flat, such that the head 205 of the fastener 200 may function as a washer when the fastener engages with the sound isolation clip 100. Additionally, the head 205 may contact the surface of the sound isolation clip 100 and substantially cover and contact the upper surface of a body portion 120 of the sound isolation clip 100 in order to hold and secure the sound isolation clip 100. This configuration generally allows a prescriptive compression to further dampen sound traveling through a wallboard and structure at various frequency ranges. In an embodiment, the diameter of the head 205 is approximately between 0.435 inches and 0.4375 inches. This generally allows the head to substantially cover the outer surface area of the body portion 120, which is generally, approximately 0.63 inches.

In a preferred embodiment, the fastener 200 is preferably a RC-1 boost mounting screw with a head 205 or wafer head diameter of 0.4375" Phillips or Square Drive. The shank 210 or shaft is preferably 0.15 inches in diameter and 2.0 inches in length, wherein 0.7 inches of the length of the shank 210 lacks threads or is without threads (i.e., smooth portion 215). The threaded portion 220 is preferably 1.30 inches and 0.190 inches in outside diameter.

FIG. 6 is an illustration of a perspective view of one embodiment of the system for sound isolation, showing installation with a resilient channel and furring channel. As shown in FIG. 6, the each embodiment of the system 600, 700 may comprise a sound isolation clip 100 and fastener 200 engaged with the flange of the resilient channel 300 or furring channel 400. As discussed above and shown therein, the sound isolation clip 100 generally matingly engages over the flange of a support channel such as a resilient channel 300 or furring channel 400. The sound isolation clip 100 is also generally secured in place by the fasteners 200, which are usually wafer head screws. The fasteners 200 preferably penetrates through the sound isolation clip 100, flange of the support channels, and structure 500 or frame member, such that the support channel fastens and suspends onto the underlying structure 500 or frame member. In another embodiment, the isolation clip 100 may be permanently attached to or part of resilient channel 300 and/or furring channel 400.

FIG. 7 is an illustration of a cross-sectional view of one embodiment of the system for sound isolation and shows the system installed onto a flange of a resilient channel. As shown in FIG. 7 another embodiment of the system 600 may comprise a sound isolation clip 100 and fastener 200 engaged with the flange of the resilient channel 300. When engaged, the smooth portion 215 of the shank 210 may contact the sound isolation clip 100 and flange of the resilient channel, such that the threaded portion 220 does not contact the sound isolation clip 100. Additionally, the bottom surface of the head 205 is substantially flat and generally contacts the upper surface of the sound isolation clip 100, such that, when the head 205 substantially covers and engages with the body portion 120 of the sound isolation clip 120. The head 205 generally holds the outer surface of the sound isolation clip 100 at a prescriptive compression to make it perform at desired frequency ranges. This configuration is generally the equivalent of adding a washer to a standard screw to engage a large amount of surface of the sound isolation clip.

FIG. 8 is an illustration of a cross-sectional view of one embodiment of the system for sound isolation and shows the system installed onto a flange of a furring channel. As shown in FIG. 8 another embodiment of the system 700 may comprise a sound isolation clip 100 and fastener 200 engaged to each flange of the furring channel 400 or resilient channel 2 (RC-2). As discussed above, when engaged, the smooth portion 215 of the shank 210 may contact the sound isolation clip 100 and flanges of the furring channel, such that the threaded portion 220 does not contact the sound isolation clip 100. Additionally, the bottom surface of the head 205 is substantially flat and generally contacts the upper surface of the sound isolation clip 100, such that, when the head 205 substantially covers and engages with the body portion 120 of the sound isolation clip 120, the head 205 holds the outer surface of the sound isolation clip 100 at a prescriptive compression to make it perform at desired frequency ranges. Similarly, this configuration is generally the equivalent of adding a washer to a standard screw to engage maximum larger portion of the surface area of the sound isolation clip. When a furring channel is used, each system for sound isolation (i.e., the sound isolation clip 100 and fastener 200) is generally spaced apart at approximately 48 inches outside corner.

Figure 9:
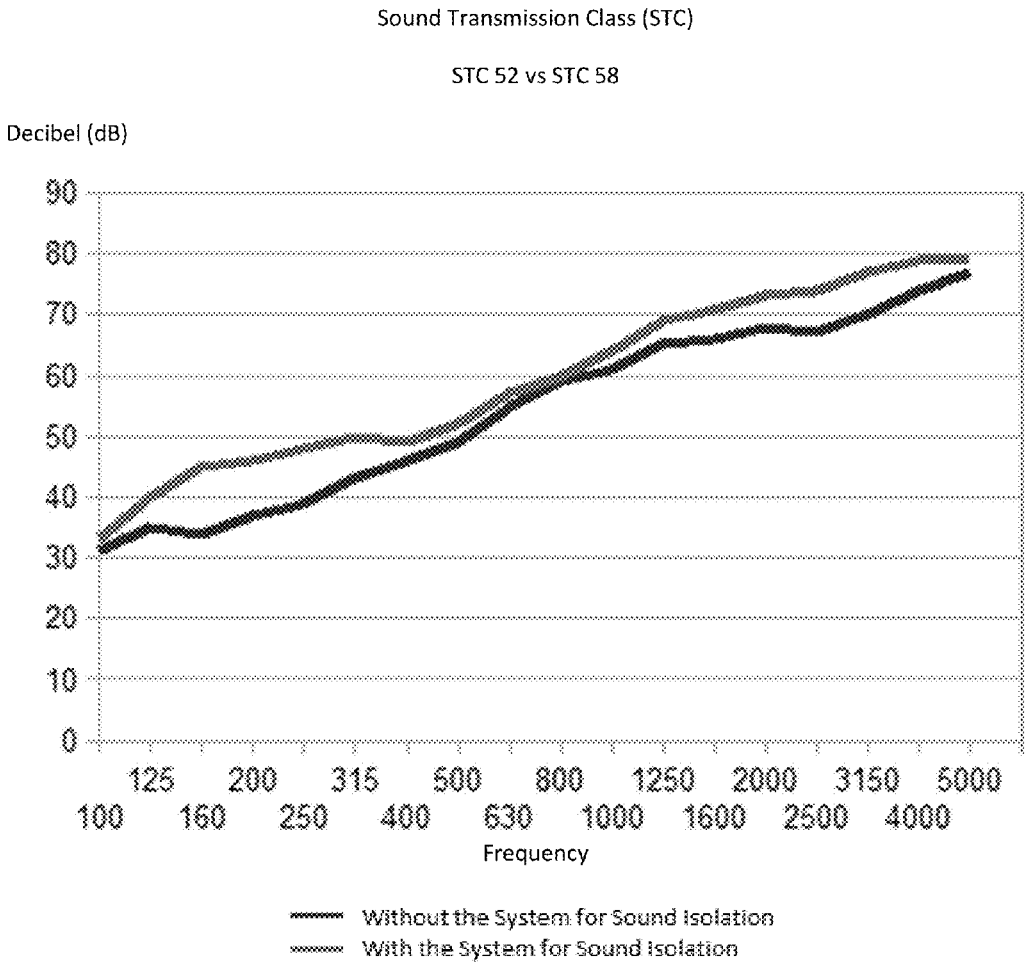
FIG. 9 is a comparison graph showing the acoustic test results on laminated finished flooring using ASTM E-90 test standards for Sound Transmission Class (STC) and shows the acoustic properties with and without the system for sound isolation.

FIG. 9 is a comparison graph showing the acoustic test results on laminated finished flooring using ASTM E-90 test standards for Sound Transmission Class (STC) and shows the acoustic properties with and without the system for sound isolation. The acoustical testing performed to proof the performance of the sound isolation clip 100 and fastener 200 (i.e., wafer head mounting screw) was conducted at NGC Testing Services, an independent testing laboratory. The floor-ceiling assemblies were acoustically tested under ASTM E-90 for Sound Transmission Class (STC). The only change between the compared tests was the addition of the system for sound isolation—i.e., the sound isolation clip 100 and fastener 200. The addition of the sound isolation clip 100 and fastener 200 improved the floor-ceiling STC by 6 points. Because STC is a 10base logarithmic expression that is exponential, every 10 point change represents a 100% change in the human perception of the noise level. Thus, the 6 point STC improvement by adding the sound isolation clip 100 and fastener 200 dramatically improved the human perception of the noise level.

Under Mass Law, one of the Laws of Physics, doubling the surface mass on both sides of a mass-air-mass assembly will result with a 6 point improvement in the STC. The STC ASTM E-90 test illustrates that the sound isolation clip 100 and fastener 200 creates a 6 point improvement in the STC. Thus, the improvement provided by the system disclosed herein is equivalent to doubling the building materials on both sides (i.e., top and bottom) of the floor-ceiling assembly. The additional cost to double the construction materials on both sides of the floor-ceiling assembly and increase the number of structural members required to support the doubling of the dead load creates substantial costs to the manufacturer and consumer. Thus, the system (i.e., the sound isolation clip 100 and fastener 200) represents a substantial cost saving to the multi-family construction industry and to the future occupants of these living units.

Figure 10:
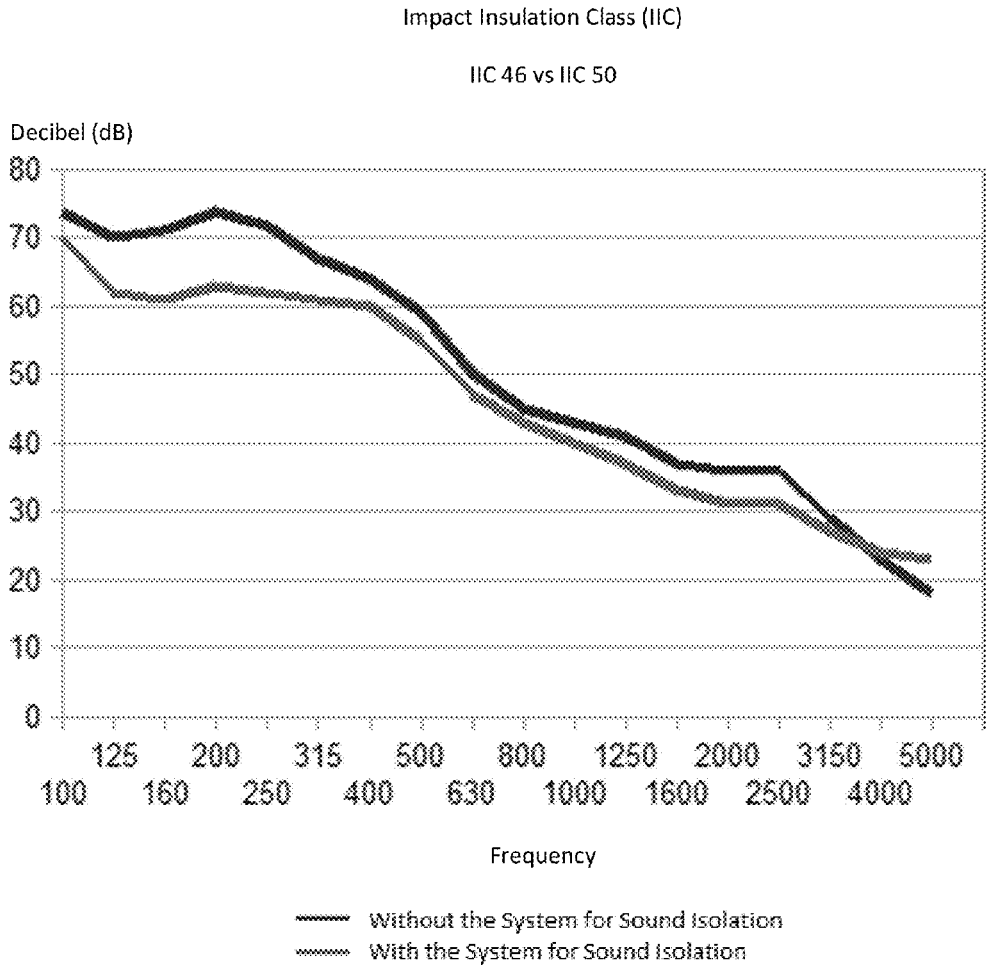
FIG. 10 is a comparison graph showing the acoustic test results on laminated finished flooring using ASTM E-492 for Impact Insulation Class (IIC) and shows the acoustic properties with and without the system for sound isolation.

FIG. 10 is a comparison graph showing the acoustic test results on laminated finished flooring using ASTM E-492 for Impact Insulation Class (IIC) and shows the acoustic properties with and without the system for sound isolation. Like test acoustical testing shown in FIG. 9, the acoustical testing performed to proof the performance of the sound isolation clip 100 and fastener 200 (i.e., wafer head mounting screw) was also conducted at NGC Testing Services. The floor-ceiling assemblies were acoustically tested under ASTM E-492 for IIC. Again, the only change between the compared tests was the addition of the system for sound isolation—i.e., the sound isolation clip 100 and fastener 200. The addition of the sound isolation clip 100 and fastener 200 improved the floor-ceiling IIC by 4 points. Because STC is a 10base logarithmic expression that is exponential, every 10 point change represents a 100% change in the human perception of the noise level. Thus, the 4 point IIC improvement by adding the sound isolation clip 100 and fastener 200 dramatically improved the human perception of the noise level.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A system for sound isolation, comprising:

a sound isolation clip;

wherein said sound isolation clip is constructed of an elastic polymer that is formed into a single unitary structure;

wherein said sound isolation clip comprises a slit, a fastener hole, and two body portions, a frame member body portion and a fastener head body portion;

wherein said slit is approximately in-between said two body portions, such that said sound isolation clip is substantially u-shaped and said two body portions are substantially in parallel;

wherein said slit is configured to allow said sound isolation clip to slideably engage with at least one flange of a support channel;

wherein said support channel comprises at least one mounting point on said at least one flange;

wherein said sound isolation clip is configured to be mounted onto said at least one mounting point of said at least one flange;

wherein said fastener hole of said sound isolation clip is adapted to allow a fastener, comprising a head and a shank, to simultaneously engage with said two body portions of said sound isolation clip and said at least one mounting point of said at least one flange of said support channel;

wherein said sound isolation clip and said support channel are configured to be mounted onto a frame member of a structure via said fastener, such that said frame member body portion of said isolation clip directly contacts said frame member, and such that said fastener head body portion of said isolation clip directly contacts said head of said fastener;

wherein said support channel is part of a barrier between two spaces; and wherein said sound isolation clip is configured to substantially isolate one or more vibrations at said frame member, such that sounds traveling between said two spaces are decreased.

2. The system for sound isolation of claim 1, wherein said shank of said fastener comprises a threaded portion and a smooth portion;

wherein said smooth portion is disposed between said head of said fastener and said threaded portion of said shank;

wherein said smooth portion of said shank is between approximately 0.6 inches and 0.65 inches and is adapted to contact said sound isolation clip and said at least one flange of said support channel when said fastener is engaged with said sound isolation clip, said support channel, and said frame member of said structure, such that said threaded portion of said shank does not contact said sound isolation clip.

3. The system for sound isolation of claim 2, wherein a thickness of said sound isolation clip is between approximately 0.4 inches and 0.6 inches, such that a thickness of each of said two body portions is approximately between 0.2 and 0.3 inches.

4. The system for sound isolation of claim 3, wherein said fastener is a wafer-head screw;

wherein a bottom surface of said head of said wafer-head screw is substantially flat;

wherein said bottom surface of said wafer head screw is configured to substantially cover and engage with a surface of said fastener head body portion of said sound isolation clip and to hold said sound isolation clip at a prescriptive compression, such that, when sound travels through said support channel and said sound isolation clip, said sound isolation clip and said fastener dampen said sound at one or more desired frequency ranges.

5. The system for sound isolation of claim 4, wherein a length of each of said two body portions is approximately between 0.6 inches and 0.65 inches; and wherein said diameter of said head of said wafer head screw is approximately between 0.4 inches and 0.45 inches.

6. The system for sound isolation of claim 1, wherein each of said two body portions is symmetrical to each other.

7. The system for sound isolation of claim 1, wherein said sound isolation clip is substantially rectangular in shape.

8. A system for sound isolation, comprising:

a sound isolation clip; and a fastener;

wherein said sound isolation clip is constructed of an elastic polymer that is formed into a single unitary structure;

wherein said sound isolation clip comprises a slit, a fastener hole, and two body portions, a frame member body portion and a fastener head body portion;

wherein said sound isolation clip lacks one or more grommets;

wherein said fastener hole is configured to allow said fastener to engage with said two body portions;

wherein said slit is approximately in-between said two body portions, such that said sound isolation clip is substantially u-shaped and said two body portions are substantially in parallel;

wherein said slit is configured to allow said sound isolation clip to slideably engage with a single flange of a support channel, such that a single sound isolation clip is used for each flange of said support channel;

wherein said flange of said support channel comprises at least one mounting point;

wherein said fastener comprises a head and a shank;

wherein said fastener hole of said sound isolation clip allows said fastener to simultaneously engage with said two body portions of said sound isolation clip and said at least one mounting point of said at least one flange of said support channel;

wherein said fastener secures said sound isolation clip and said support channel to a frame member of a structure, such that said fastener hole of said frame member body portion of said isolation clip directly contacts said frame member, and such that said fastener head body portion of said isolation clip directly contacts said head of said fastener;

wherein said support channel is part of a barrier between two spaces; and wherein said sound isolation clip and said fastener are configured to substantially isolate one or more vibrations at said frame member, such that sounds traveling between said two spaces are decreased.

* * * * *